US007617864B2

(12) United States Patent
Gallerneault

(10) Patent No.: US 7,617,864 B2
(45) Date of Patent: Nov. 17, 2009

(54) CLADDING INGOT TO PREVENT HOT-TEARING

(75) Inventor: Willard Mark Truman Gallerneault, Glenburnie (CA)

(73) Assignee: Novelis Inc., Toronto, Ontario (CA)

( * ) Notice: Subject to any disclaimer, the term of this patent is extended or adjusted under 35 U.S.C. 154(b) by 155 days.

(21) Appl. No.: 11/703,029

(22) Filed: Feb. 5, 2007

(65) Prior Publication Data

US 2007/0215312 A1 Sep. 20, 2007

Related U.S. Application Data

(60) Provisional application No. 60/778,055, filed on Feb. 28, 2006.

(51) Int. Cl.
*B22D 11/00* (2006.01)
*B22D 11/049* (2006.01)

(52) U.S. Cl. ..... 164/461; 164/487

(58) Field of Classification Search ..... 164/461, 164/487, 437, 488; 428/650
See application file for complete search history.

(56) References Cited

U.S. PATENT DOCUMENTS

| | | | | |
|---|---|---|---|---|
| 4,377,425 | A * | 3/1983 | Otani et al. | 148/437 |
| 4,567,936 | A * | 2/1986 | Binczewski | 164/453 |
| 5,106,429 | A * | 4/1992 | McAuliffe et al. | 148/552 |
| 6,260,602 | B1 | 7/2001 | Wagstaff | |
| 2005/0011630 | A1 | 1/2005 | Anderson et al. | |
| 2007/0215313 | A1 | 9/2007 | Wagstaff | |
| 2008/0008903 | A1 | 1/2008 | Bull et al. | |

* cited by examiner

*Primary Examiner*—Kevin P Kerns
(74) *Attorney, Agent, or Firm*—Cooper & Dunham LLP

(57) ABSTRACT

A method of casting an ingot of a metal having a susceptibility to hot-tearing while avoiding such hot tearing. The method involves co-casting a cladding metal on a surface of a metal core ingot as the ingot is being cast in a DC casting procedure. The cladding layer preferably contacts the core ingot at a position on the ingot surface where the metal of the ingot is incompletely solid, e.g. at a temperature between its solidus temperature and liquidus temperatures. The metal of the core ingot and the metal of the cladding layer are the same and, if they contain grain refiners, the are present in an amount of 0.005% by weight of the metal or less.

10 Claims, 4 Drawing Sheets

CLADDING INGOT TO PREVENT HOT-TEARING

CROSS-REFERENCE TO RELATED APPLICATION

This application claims the benefit of the priority right of our prior co-pending provisional patent application Ser. No. 60/778,055 filed Feb. 28, 2006. The entire contents of the provisional application are specifically incorporated herein by this reference.

BACKGROUND OF THE INVENTION (1) Field of the Invention

This invention relates to the casting of metals, particularly aluminum and aluminum alloys. More particularly, the invention relates to the casting of such metals by direct chill casting techniques.

(2) Description of the Related Art

Metal ingots are commonly produced by direct chill (DC) casting of molten metals by means of which a molten metal is poured into a mold having an open upper end and (after start-up) an open lower end. The metal emerges from the lower end of the mold as a metal ingot that descends as the casting operation proceeds. In other cases, the casting takes place horizontally, but the procedure is essentially the same. Such casting techniques are particularly suited for the casting of aluminum and aluminum alloys. Unfortunately, ingots of certain metals cast in this way may be susceptible to so-called "hot-tearing" (also known as "hot-cracking") as the ingots emerge from the mold and before they have fully solidified. Hot-tearing means the formation of a crack of critical size at the surface of the ingot following chilling but before full metal solidification. This may be caused by the shrinkage of the metal as the cooling and solidification proceeds and also by the mechanical contribution of thermal stresses. Some alloys are more susceptible to hot-tearing than others, and hot-tears are most prevalent in AlCu alloys (e.g. AA2xxx series aluminum alloys), with the effect being most pronounced at a Cu-content of about 1.4% by weight. Some aluminum magnesium alloys particularly (Al-2.5 wt. % Mg) are also susceptible to hot-tearing.

To minimize hot tearing in such alloys, it is known to add so-called "grain refiners" to the molten metal. Grain refiners decrease the hot-tear sensitivity of the metal by promoting a fine grain structure in the metal as it solidifies. Fine grains dissipate the accumulated stresses during solidification due to their increased number and density. In particular, grain refiners act to increase the number of solidification sites and thus average-out and redistribute the stresses (associated with the shrinkage that takes place with the generation of solid) that accumulate during solidification and that lead to hot-tears. Materials used in this way as grain refiners include AlTi, $TiB_2$, AlBTi, TiCAl and TiC. Such grain refiners may be produced by co-melting metals to produce a master alloy, adding further ingredients if desired, and adding the master alloy to the metal alloy intended for casting. Ti and $TiB_2$ are the most commonly used grain refiners for aluminum alloys. They are usually added to the main alloys in amounts of 0.01 wt. % or more, and the added amounts tend to be at the higher end when casting metals subject to hot-tearing (in contrast to other metals where the grain refiners may be added to produced desired physical properties of the cast alloy). Unfortunately, these materials tend to be relatively expensive and have to be distributed thoroughly throughout the molten metal and are not always as effective as would be desired.

Moreover, in some cases, the metallurgy desired for a particular application may not be that produced by the use of grain refiners added to control hot-tearing.

There is therefore a need for an improved way of controlling hot tearing during the DC casting of such metals.

BRIEF SUMMARY OF THE INVENTION

An exemplary embodiment of the invention provides a method of direct chill casting a metal that is susceptible to hot-tearing during casting. The method involves casting a core ingot of a metal that is susceptible to hot-tearing during casting, and co-casting a cladding layer of the same metal on at least one outer surface of the ingot, the cladding layer being co-cast onto said core ingot at a position where said metal of the ingot at said surface has not undergone complete solidification following casting. If the metal of the cladding and/or the core contains a grain refiner, the grain refiner is present in an amount of 0.005% by weight of the metal or less. Preferably, the metal of the cladding layer is co-cast onto the surface of the ingot at a position where the metal of the ingot at the surface is at a temperature between its solidus temperature and its liquidus temperature.

Another exemplary embodiment provides a DC cast ingot having a core and a cladding layer on the surface of the core. The cladding layer and the core are made of the same metal alloy and both are free of hot-tears formed at the ingot surface. If the metal of the cladding layer or the core ingot contains a grain refiner, the amount is less than 0.005% by weight of the metal.

By the term "metal susceptible to hot-tearing" we mean a metal that undergoes hot-tearing sufficiently frequently during DC casting to cause substantial commercial disadvantages during ingot manufacture. Metals of this kind are well known to persons skilled in the art. Examples include, but are not limited to, AlCu alloys and AlMg alloys.

By the term "same metal" or "same alloy", we mean that two metals or alloys have the same content of essential constituent elements, but they may differ with respect to the presence and content of grain refiners.

AA5xxx alloys may be candidates for the present invention. For example, alloy AA5454 is an Al—Mg alloy that is very susceptible to hot-tearing and needs the addition of a significant level of grain refiners during normal DC casting. The metal is therefore a good candidate for use in the present invention. The composition of this alloy is:

Mn 0.50-0.10 wt. %
Mg 2.4 to 3.0 wt. %
Cr 0.05 to 0.20 wt. %
Ti up to a maximum of 0.20 wt. %
Si up to a maximum of 0.25 wt. %
Fe up to a maximum of 0.40 wt. %
Cu up to a maximum of 0.10 wt. %
Zn up to a maximum of 0.25 wt. %
Impurity elements up to 0.05 wt. % individually, and up to 0.15 wt. % collectively
Al Balance In this alloy, the maximum level of Ti is normally used as a grain refiner when the alloy is cast by DC techniques.

Examples of Al—Cu alloys for use in the invention include AA2xxx series alloys, e.g. AA2006, which has the following composition:

Cu 1.0-2.0 wt. %
Si 0.8-1.3 wt. %
Mn 0.6-1.0 wt. %
Mg 0.50-1.40 wt. %
Ti up to a maximum of 0.30 wt. %

Fe up to a maximum of 0.70 wt. %
Ni up to a maximum of 0.20 wt. %
Zn up to a maximum of 0.20 wt. %
Impurity elements up to 0.05 wt. % individually, and up to 0.15 wt. % collectively
Al Balance.

Note: the expression "up to a maximum" means that the indicated element may be absent (0 wt. %) or present up to the maximum stated.

DETAILED DESCRIPTION OF THE INVENTION

The present invention makes it possible to control hot-tearing in a way that eliminates the need for grain refiners or that, at least, minimizes the required content of such materials. This result is achieved by co-casting a layer of cladding metal onto a core ingot using the same metal both for the cladding layer and the core ingot. This is especially effective when carried out using the co-casting apparatus described in U.S. Patent Publication No. 2005/0011630, published on Jan. 20, 2005 in the name of Anderson et al. (the disclosure of which is incorporated herein by reference). This apparatus makes it possible to co-cast metals to form a core ingot and a cladding layer and to produce a substantially continuous metallurgical bond between the metal layers.

Figure 1:
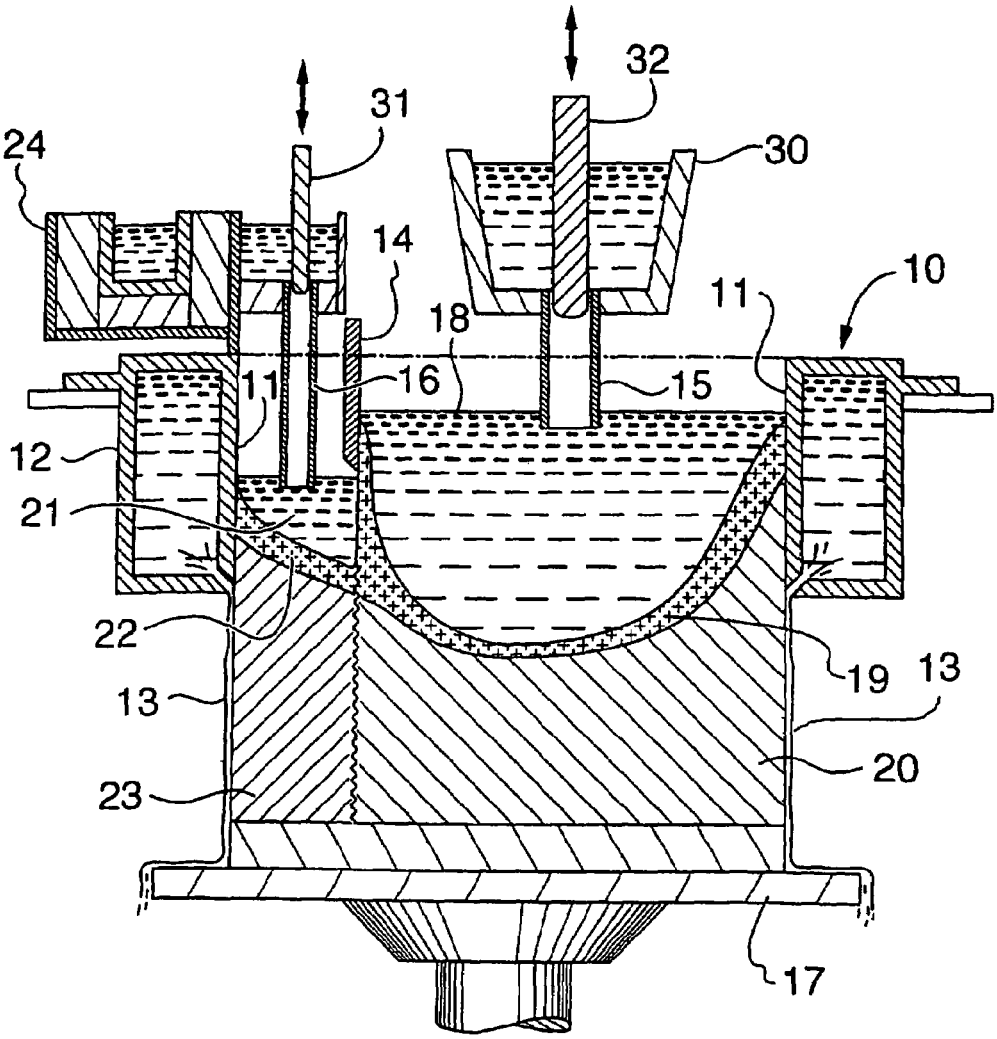
FIG. 1 is an elevation in partial section showing an example of a co-casting apparatus used in the present invention.
Figure 2:
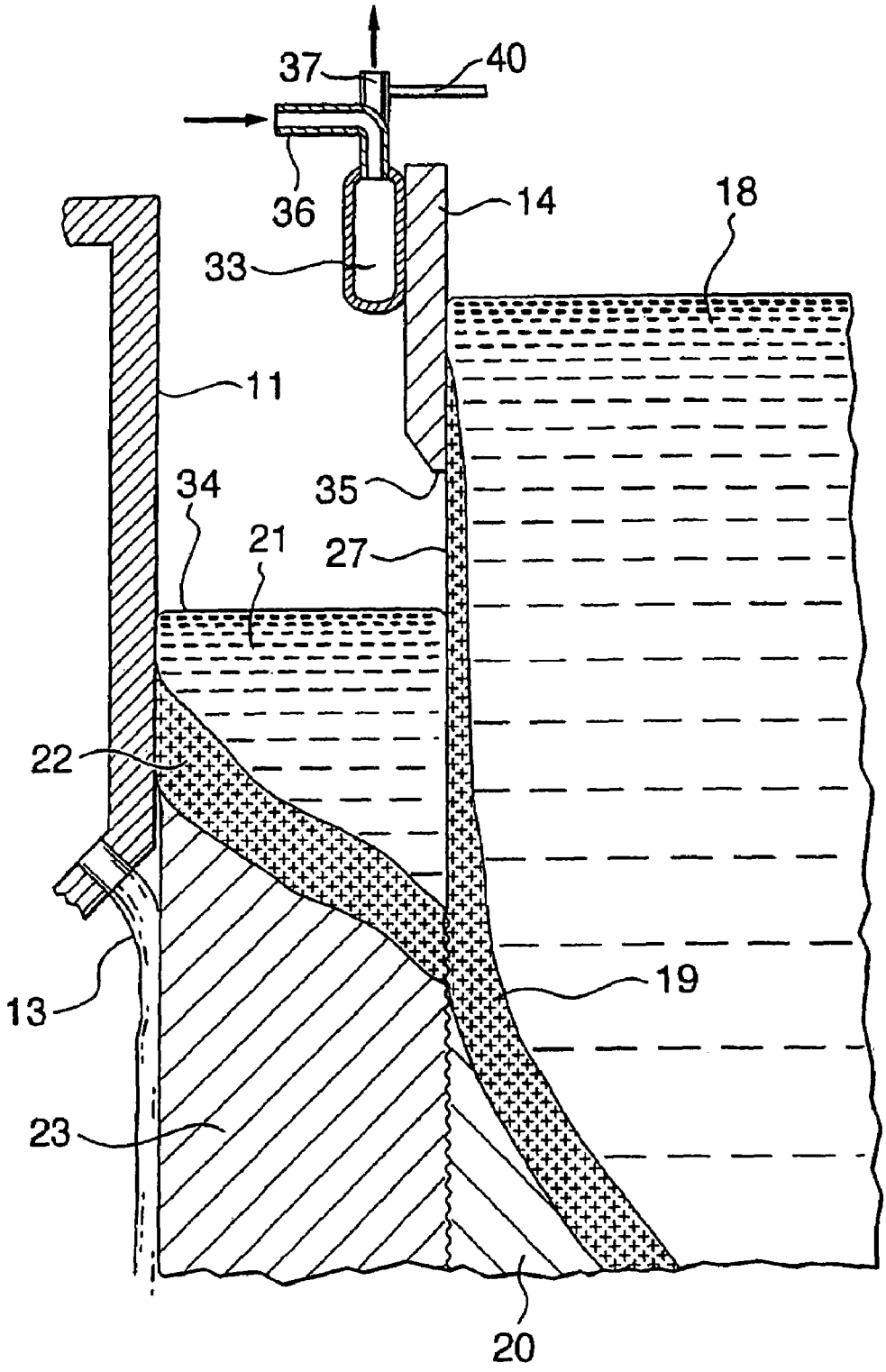
FIG. 2 is an enlargement of part of the apparatus of FIG. 1 showing contact between the co-cast metals.

FIGS. 1 and 2 of the accompanying drawings show the co-casting mold assembly of the Anderson et al. publication in elevation and partial cross-section. The figures show a rectangular casting mould assembly 10 that has mould walls 11 forming part of a water jacket 12 from which a stream of cooling water 13 is dispensed.

The feed portion of the mould is separated by a divider wall 14 into two feed chambers. A molten metal delivery trough 30 and delivery nozzle 15 equipped with an adjustable throttle 32 feeds a first alloy into one feed chamber to form a body of molten metal 18, and a second metal delivery trough 24 equipped with a side channel, delivery nozzle 16 and adjustable throttle 31 feeds a second alloy into a second feed chamber to form a body 21 of molten metal. The adjustable throttles 31, 32 are adjusted either manually or responsive to some control signal to adjust the flow of metal into the respective feed chambers. A vertically movable bottom block unit 17 supports the embryonic composite ingot being formed and fits into the outlet end of the mould prior to starting a cast and thereafter is lowered to allow the ingot to form.

As more clearly shown with reference to FIG. 2, in the first feed chamber, the body of molten metal 18 gradually cools so as to form a self-supporting surface 27 adjacent the lower end of the divider wall 14 and then forms a zone 19 that is between liquid and solid and is often referred as a mushy zone. Below this mushy or semi-solid zone is a solid metal alloy 20. A liquid flow of a second alloy is fed into the second feed chamber to form a body 21 of a molten metal alloy that, in the present invention, is the same alloy as that introduced into the first feed chamber. This metal also forms a mushy zone 22 and eventually a solid portion 23.

The self-supporting surface 27 typically undergoes a slight contraction as the metal detaches from the divider wall 14 then a slight expansion as the splaying forces caused, for example, by the metallostatic head of the molten metal 18 come to bear. The self-supporting surface 27 has sufficient strength to restrain such forces even though the temperature of the surface may be above the solidus temperature of the metal 18. An oxide layer on the surface can contribute to this balance of forces.

The temperature of the divider wall 14 is maintained at a predetermined target temperature by means of a temperature control fluid passing through a closed channel 33 having an inlet 36 and outlet 37 for delivery and removal of temperature control fluid that extracts heat from the divider wall so as to create a chilled interface which serves to control the temperature of the self supporting surface 27 below the lower end 35 of the divider wall 14. The upper surface 34 of the metal 21 in the second chamber is then maintained at a position below the lower end 35 of the divider wall 14 and at the same time the temperature of the self supporting surface 27 is maintained such that the surface 34 of the metal 21 contacts the self supporting surface 27 at a point where the temperature of the surface 27 lies between the solidus and liquidus temperature of the metal 18. Typically the position of the surface 34 is controlled at a point slightly between the lower end 35 of the divider wall 14, generally within about 2 to 20 mm from the lower end. The interface layer thus formed between the two alloy streams at this point forms a very strong metallurgical bond between the two layers without excessive mixing of the alloys.

The coolant flow (and temperature) required to establish the temperature of the self-supporting surface 27 of metal 18 within the desired range is generally determined empirically by use of small thermocouples that are embedded in the surface 27 of the metal ingot as it forms and once established for a given composition and casting temperature for metal 18 (casting temperature being the temperature at which the metal 18 is delivered to the inlet end of the feed chamber) forms part of the casting practice for such an alloy. It has been found in particular that, at a fixed coolant flow through the channel 33, the temperature of the coolant exiting the divider wall coolant channel measured at the outlet 37 correlates well with the temperature of the self supporting surface of the metal at predetermined locations below the bottom edge of the divider wall, and hence provides for a simple and effective means of controlling this critical temperature by providing a temperature measuring device such as a thermocouple or thermistor 40 in the outlet of the coolant channel.

Figure 3:
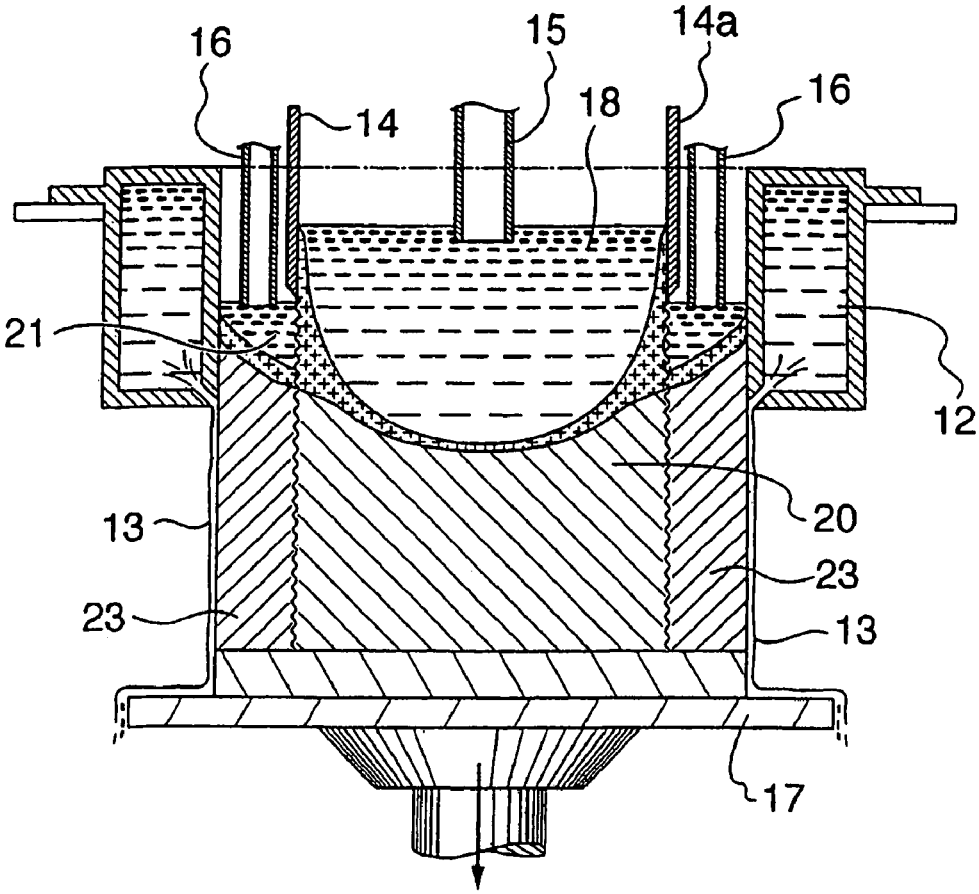
FIG. 3 is a view similar to that of FIG. 1 showing casting apparatus suitable for cladding both major faces of a rectangular core ingot.
Figure 4:
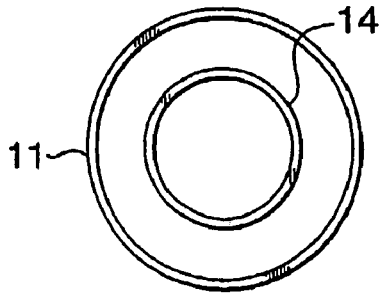
FIG. 4 is a simplified plan view of a casting mold suitable for producing a cylindrical ingot having an annular outer cladding.

FIG. 3 shows a version of the apparatus for casting a cladding layer on both major surfaces of a rectangular core ingot, and FIG. 4 shows a version for casting an annular cladding layer on a cylindrical core ingot. The reference numerals shown in FIG. 3 are the same as those in FIG. 1, except that an extra divider wall 14*a* is shown on the opposite side of the mold to divider wall 14. This allows for the formation of a second cladding layer 23. In the case of FIG. 4, the mold wall 11 is annular, as is the single divider wall 14.

In the present invention, cladding metal is preferably co-cast onto at least one surface of the core ingot at a point on the ingot as close as possible to the mold outlet, and preferably at a point closer to the outlet than the normal position where hot-tearing commences. The cladding layer should preferably be present on the ingot before surface segregation and surface defect formation has commenced at the outer surface of the ingot. Ideally, the cladding layer should be applied to the ingot at a position where the surface metal is between the liquidus and solidus temperatures.

Figure 5:
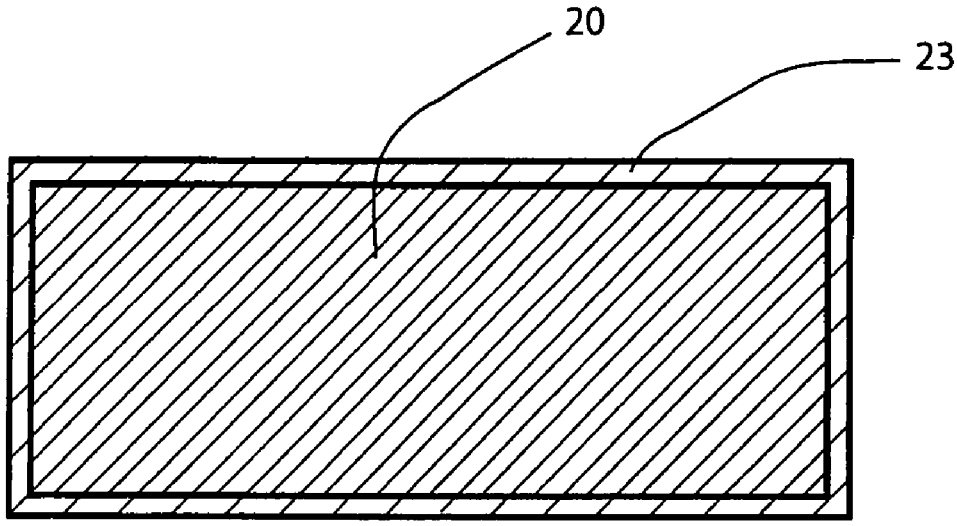
FIG. 5 is a cross-section of a rectangular ingot having a continuous cladding layer on all faces thereof.

Preferably, all of the side surfaces of the ingot are clad using this technique, so that the core ingot is completely encapsulated within a layer of cladding metal of essentially the same composition. An example of this for a rectangular ingot is shown in FIG. 5 having a solid core 20 and a thin cladding 23. However, co-casting on one or both major surfaces of a rectangular ingot will be of help because the major surfaces are more susceptible to hot tearing. The core ingot may, of course, be of any shape and does not have to be rectangular. For example, the core ingot may be cylindrical, e.g. as produced by the apparatus of FIG. 4.

As noted, the metal chosen for the cladding layers is the same as the metal chosen for the core ingot, this metal being one that is susceptible to hot-tearing during DC casting, particularly AlCu alloys. The use of the same metal for the cladding as for the core ingot provides what is essentially a monolithic ingot required for many purposes. The metals of both the core and cladding may be completely free of grain refiners, such as those mentioned above. Without wishing to be restricted to any particular theory, it is believed that, as the cladding layer cools much more quickly than the core ingot (due to its position at the surface), the cladding layer will have a finer microstructure than the core due to its higher cooling rate and shorter solidification time. Since hot-tearing is a surface phenomenon, the cladding layer imparts protection to the core by providing a mostly solidified barrier to stresses and liquid movement from the core to the surface.

However, it is also found advantageous to use small amounts of grain refiners either in the cladding metal, in the core metal, or both. These amounts are generally less than half, and normally less than one quarter, of the amounts normally used in conventional techniques to cause desirable metallurgical effects, including resistance to hot-tearing. The amount of grain refiner used for the cladding and the core may differ, and normally less grain refiner (or no grain refiner at all) would be used for the cladding than for the core (because of the faster cooling rate of the cladding layer). In general, the amount of grain refiner for the cladding need not exceed 0.005 wt. %.

It is found that almost any thickness of the cladding layer provides an improvement to the resistance to hot-tearing, but thickness of 5% of more of the thickness of the core ingot are found to be particularly suitable. Generally, a thickness of 5 to 10% or more of the thickness of the core ingot is suitable. However, it should be noted that hot-tears form due to surface segregation and surface defect regions which generally form within a few hundred micrometers of the surface, so very thin layers are suitable if they can be produced. A cladding layer having any thickness above this distance will help to reduce the susceptibility to hot tearing.

The invention claimed is:

1. A method of direct chill casting an Al—Mg alloy that is susceptible to hot tearing during casting, which method comprises;

melting an Al—Mg alloy that is susceptible to hot tearing during casting and delivering the molten metal to a first chamber of a co-casting apparatus to form a first body of molten metal;

melting the same Al—Mg alloy and delivering the molten metal to a second chamber of a co-casting apparatus to form a second body of molten metal;

casting a core ingot from said first body of molten metal, and co-casting a cladding layer from said second body of molten metal on at least one outer surface of said core ingot, said cladding layer being co-cast onto said core ingot at a position where said metal of the core ingot at said surface has not undergone complete solidification following casting;

said thickness of said cladding layer relative to said core ingot being made effective to impart a finer microstructure to said cladding layer than to said core ingot, and to eliminate hot tears during casting.

2. The method of claim 1, wherein said first and said second body of molten metal are free of grain refiners.

3. The method of claim 1, wherein a grain refiner is added to said molten metal delivered to said first chamber, to said molten metal delivered to said second chamber or to said molten metals delivered to both said first chamber and said second chamber, said grain refiner being added to said metal in an amount of 0.005% by weight of said metal or less.

4. The method of claim 3, wherein said grain refiner is added to said molten metals delivered to both said chambers, but an amount of said grain refiner added to the molten metal delivered to said second chamber is less than an amount of said grain refiner added to the molten metal delivered to said first chamber.

5. The method of claim 3, wherein said grain refiner is added only to said molten metal delivered to said first chamber.

6. The method of claim 1, wherein said molten metal from the second chamber is co-cast onto said at least one surface of the core ingot at a position where the metal of the core ingot at said surface is at a temperature between a solidus temperature and a liquidus temperature of the metal of the core ingot.

7. The method of claim 1, wherein said Al—Mg alloy contains about 2.5% by weight Mg.

8. The method of claim 1, wherein said thickness of said cladding layer is at least 5% of the thickness of said core ingot.

9. The method of claim 1, wherein said thickness of said cladding layer is within the range of 5 to 10% of the thickness of said core ingot.

10. The method of claim 1, wherein said cladding layer is co-cast onto all side surfaces of said core ingot.

* * * * *